United States Patent [19]

Baldi et al.

[11] 4,041,196

[45] Aug. 9, 1977

[54] DIFFUSION TREATMENT OF METAL

[75] Inventors: Alfonso L. Baldi, Drexel Hill, Pa.; Victor V. Damiano, Pennsauken, N.J.

[73] Assignee: Alloy Surfaces Company, Inc., Wilmington, Del.

[21] Appl. No.: 576,981

[22] Filed: May 13, 1975

Related U.S. Application Data

[63] Continuation-in-part of Ser. No. 507,126, Sept. 18, 1974, abandoned, and Ser. No. 466,908, May 3, 1974, Pat. No. 3,958,047, which is a continuation-in-part of Ser. No. 328,378, Jan. 31, 1973, Pat. No. 3,867,184.

[51] Int. Cl.[2] ..... C23C 9/00

[52] U.S. Cl. ..... 427/252; 427/253; 118/48; 118/49; 428/656; 428/667

[58] Field of Search ..... 427/252, 253; 118/48, 118/49, 49.1, 49.5; 29/197, 194

[56] References Cited

U.S. PATENT DOCUMENTS

| | | | |
|---|---|---|---|
| 2,955,957 | 10/1960 | Dorner | 427/252 |
| 3,096,205 | 7/1963 | DeGuisto | 427/253 |
| 3,338,733 | 8/1967 | Rowady | 29/194 |
| 3,343,982 | 9/1967 | Maxwell et al. | 427/253 |
| 3,493,476 | 2/1970 | Lucas et al. | 29/197 |
| 3,656,919 | 4/1972 | Lucas et al. | 29/197 |
| 3,764,373 | 10/1973 | Speirs et al. | 427/253 |
| 3,785,854 | 1/1974 | Baldi | 427/252 |

*Primary Examiner*—Ralph S. Kendall
*Assistant Examiner*—Charles R. Wolfe, Jr.
*Attorney, Agent, or Firm*—Connolly and Hutz

[57] ABSTRACT

In the pack diffusion coating of chromium into the surface of a superalloy, the formation of undesirable oxide inclusion is reduced when the diffusion coating pack contains at least about 3% $Ni_3Al$. Also the formation of alpha-chromium is reduced when the pack diffusion is carried out in a retort effectively not over five inches in height. Pack aluminizing in the presence of chromium makes a very effective aluminum- and chromium-containing top coating over platinum plated or platinum coated nickel-base superalloys. Aluminized nickel can also have its aluminum attacked and at least partially removed with aqueous caustic to leave a very highly active catalytic surface. Pack diffusion can also be arranged to simultaneously provide different coatings in different locations by using different pack compositions in those locations. An aluminizing pack containing a large amount of chromium provides a thinner aluminized case than an aluminizing pack containing less chromium, or less chromium and some silicon. A cobalt-chromium pack deposits essentially a chromized case when energized with a chloride, but deposits large amounts of cobalt along with chromium when energized with an iodide. Even more chromium with large amounts of cobalt are deposited when the energizer is a mixture of iodide and chloride. Depletion of diffusible material from workpieces heated in a powder-pack can also be readily controlled by adjusting the pack composition, and such depletion from cobalt-base superalloys very simply provides a surface on which aluminizing produces a highly impact-resistant coating.

6 Claims, 4 Drawing Figures

DIFFUSION TREATMENT OF METAL

This application is a continuation-in-part of application Ser. No. 507,126 filed Sept. 18, 1974 (subsequently abandoned) and application Ser. No. 466,908 filed May 3, 1974 now U.S. Patent 3958047, both of which are in turn continuations-in-part of application Ser. No. 328,378 filed Jan. 31, 1973 (U.S. Pat. No. 3,867,184, granted Feb. 18, 1975).

The present invention relates to the treatment of metal by diffusion coating.

Among the objects of the present invention is the provision of improved coating and treating processes and improved products thus formed. A particular object is to protect metals against corrosion or oxidation at elevated temperatures. Another object is the provision of a novel catalyst material.

The foregoing as well as additional objects of the present invention will be more fully understood from the following description of several of its exemplifications, reference being made to the accompanying drawings wherein.

Figure 1:
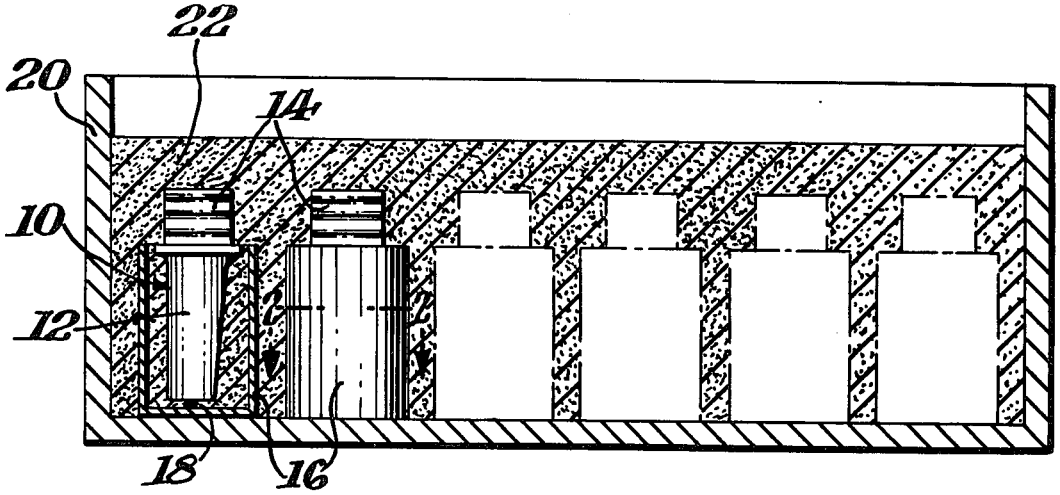
FIG. 1 is a sectional view of a packed retort for carrying out a differential coating process of the present invention.

It is known that superalloy articles such as turbine vanes and blades as well as burner rings in the hot section of jet engines can be diffusion coated with chromium and then diffusion coated with aluminum to improve their resistance to corrosion and oxidation at temperatures as high as 1100° C.

One very effective technique for chromizing a superalloy workpiece in preparation for the aluminizing is as follows:

EXAMPLE 1

A group of B-1900 jet engine blades was packed in a cup-shaped retort 4 inches high in an $NH_4Cl$-energized diffusion coating pack having 14% powdered chromium and 15% powdered $NI_3Al$. The remainder of the pack was alumina, but can be any other inert material. The energizer content was ½% by weight of the total of the other pack ingredients. Chromizing was conducted in a hydrogen-bathed atmosphere, as in U.S. Pat. No. 3,764,371, with the retort loosely covered, holding a 1925° F temperature for 20 hours, giving a very uniform chromized case about 0.7 mils deep, essentially free of oxide inclusions and without the formation of alpha-chromium phase.

In the event the $Ni_3Al$ content of the pack is omitted or is less than about 3% by weight, a substantial amount of oxide inclusions are formed in the case, and these may cause the case to spall off under the influence of repeated thermal shock treatment, particularly if their number increases to form a continuous layer of inclusions. Such inclusions tend to form in the chromium diffusion case of any superalloy containing aluminum and/or titanium. The number of such inclusions formed diminishes sharply when the $Ni_3Al$ content of the pack is at least 3% by weight, and reaches a minimum when the $Ni_3Al$ content is about 6%. As much as about 20% $Ni_3Al$ can be contained in the pack so that there is considerable tolerance for it and a wide concentration range for its use. It is preferred to use 8 to 15% $Ni_3Al$ so as not to require accurate measuring and also to make it unnecessary to add make-up $Ni_3Al$ after each use of the chromizing pack.

In addition to reducing oxide inclusions, the $Ni_3Al$ behaves like an inert diluent in the pack since it does not interfere significantly with the chromizing. Thus the chromium content of the pack can be as low as 10% and as high as 40%, regardless of the $Ni_3Al$ content.

The formation of oxide inclusions during chromizing is also reduced when the chromizing takes place in an evacuated atmosphere as described for example in U.S. Pat. No. 3,290,126 granted Dec. 6, 1966. In an evacuated atmosphere the chromium content of the pack should be relatively high, e.g. from about 25 to about 60% by weight to keep the chromizing time from exceeding 30 hours, and the energzer should be a non-volatile halide.

The foregoing reduction in oxide inclusion and alpha-chromium phase formation is also obtained when other nickel-base superalloys are substituted for the B-1900 alloy of Example 1. Such alternative superalloys include any alloy having 50 to 75% nickel and a little aluminum or titanium. Also the $Ni_3Al$ can be replaced by intermetallics ranging from $Ni_{3.5}Al$ to $Ni_2Al$ with equivalent results.

When chromizing the foregoing superalloys at atmospheric pressure or at somewhat above atmospheric pressure there is a tendency to form alpha phase chromium on the chromized superalloy workpiece even when the chromium pick-up is as low as 1 to 3 milligrams per square centimeter of surface. Such alpha phase formation is helpful in that after a subsequent aluminizing coated members have greater resistance to corrosion, as much as three or more times the resistance to corrosion in hot sulfidizing atmospheres. However the alpha chromium tends to be brittle and does not provide a good surface for receiving vapor-deposited top coatings such as that described in U.S. Pat. No. 3,676,085. By using a cup-shaped retort effectively not over 5 inches in height, it has been discovered that the formation of alpha chromium phase is prevented. Retort cups taller than 5 inches can be effectively used without alpha chromium formation by perforating the side wall of the retort at a level within 5 inches of its bottom. The perforations can be ⅛ inch diameter holes drilled through the retort wall to provide venting about 1 to 2 square inches in cross-sectional area for every pound of diffusion coating pack. Small holes such as those ⅛ inch in diameter generally do not permit any significant amount of the pack to spill out through them, but larger size holes can be used and covered by a wire screen when the retort is being loaded.

It is preferred to maintain an effective retort height of at least two inches, as by providing the foregoing venting at least two inches up from the bottom of the retort. It should also be noted that such venting is not to the air but to the space that surrounds the inner retort. That spaced is bathed by a stream of hydrogen, but can instead be bathed by a stream of inert gas like argon, during the chromizing. In general this reduction in alpha phase formation is obtained with any chromium-diffusion pack but it does not require the presence of any of the foregoing nickel aluminide intermetallics in the pack. However the presence of 35 or more of such intermetallic in the pack will even further reduce the tendency to form alpha chromium. Modifying Example 1 by replacing its retort with an unperforated retort cup 10 inches high will provide a chromized case about 1.5 mils thick with a substantial content of alpha chromium and suitable for subsequent aluminizing to make an excellent product that without further treatment has unusually good sulfidation resistance.

The diffusion aluminizing that follows the diffusion chromizing can be either an inhibited or an uninhibited aluminizing. The uninhibited aluminizing is conducted with no more than a slight amount of chromium, or none at all, present in the aluminizing pack. A chromium content about half that of the aluminum, by weight, inhibits the aluminizing by greatly reducing the aluminum coating rate and is described for instance in U.S. Pat. No. 3,257,230. As pointed out in that patent, larger proportions of chromium to aluminum cam also be used in the inhibited aluminizing, and proportions greater than 3:1 by weight cause some of the chromium to diffuse into the aluminized case along with the aluminum.

A very effective combination of the foregoing coatings is illustrated in the following example.

EXAMPLE2

First hot stage jet engine vanes, some made of Rene 77 alloy and some of Rene 80 alloy were packed in a powder coating pack in a 10-inch high retort. The pack had the following composition, by weight:

| | | |
|---|---|---|
| Very fine chromium (20 micron size or less) | | 45% |
| Pre-fired mixture of 49.2 parts $Al_2O_3$ | | |
| 42.8 parts Ni | | |
| 6.5 parts Al | | |
| 1.5 parts Cr | | |
| | | 55% |
| $NH_4Cl$ energizer | 0.5% of the foregoing | |

The entire pack has been prefired at 1925° F for 5 hours and its energizer content brought up to the designated amount with fresh $NH_4Cl$.

After the packing is completed the retort is loosely covered and heated in a hydrogen-bathed atmosphere as described in Example 1, to 1925°-1975° F where it is kept for 10 hours. After cooling the workpieces are removed, cleaned as by lightly blasting with fine glass powder, and both alloys show a 1.5 mil thick diffusion coating case the outermost third of which is rich in alpha chromium. The thus-coated workpieces are then given an inhibited aluminizing treatment as described in Example I of U.S. Pat. No. 3,801,357, but without the masking there referred to. A 10-hour aluminizing carried out in that manner at 1950° F produces a total diffusion coating case about 3 mils thick on the Rene 77 alloy and about 2.5 mils thick on the Rene 80 alloy. These coated members are unusually resistant to sulfidizing corrosion at temperatures of 1900° F.

The foregoing Rene alloys are nickel-base superalloys having the following approximate compositions in percent by weight:

| | Ni | Cr | Co | Mo | W | Al | Ti | C | B | Zr |
|---|---|---|---|---|---|---|---|---|---|---|
| Rene 77 | 58 | 14.6 | 15 | 4.2 | 0 | 4.3 | 3.3 | 0.07 | 0.016 | 0.04 |
| Rene 80 | 60 | 14.0 | 9.5 | 4. | 4.0 | 3. | 5.0 | 0.17 | 0.015 | 0.03 |

Similar results are also obtained with other nickel-based superalloys as well as with cobalt-based superalloys.

Chromium-inhibited aluminizing is particularly desirable as a top coating over a platinum diffusion or electroplated coating on nickel-base superalloys, and in such a combination provides greater sulfidation resistance at high temperatures than the use of the uninhibited aluminizing in such a combination as described in U.S. Pat. No. 3,677,789 granted July 18, 1972. The same advantage is obtained when other platinum metals, particularly palladium, are used in place of platinum. Additional suitable examples of chromium-inhibited aluminizing are described in Canadian Pat. NO. 806,618 issued Feb. 18, 1969, as well as in U.S. Pat. No. 3,257,230. The nickel-based superalloys are also described in those patents and generally are those high temperature alloys which contain at least about 50% nickel and about 6 to 25% chromium.

The following coating illustrates this coating combination:

EXAMPLE 3

A jet engine (hot section) blade of B-1900 alloy and electroplated with a 0.0003 inch thick layer of platinum was subjected to a hydrogen-bathed pack diffusion coating at 1890° F for 12 hours, in a previously used pack consisting of, by weight:

magnesothermic chromium powder; 45%
alumina (−325 mesh); 45%
aluminum powder (−325 mesh); 10% activated with 1/2% $NH_4Cl$.

The thus treated blade has a 0.003 inch thick diffusion case and also shows exceptional hot sulfidation resistance.

Other types of very finely divided chromium less than 10 microns in size can be used in place of the magnesothermic powder in the foregoing example.

Similar hot sulfidation resistance is obtained for DS nickel if it is first chromized, as described in U.S. Pat. No. 3,785,854, for example, then given a thin platinum overcoating as by electroplating or vapor condensation, and then aluminized as also described in U.S. Pat. No. 3,785,854. Thus a 4 to 6 mil chromized case with a 0.2 to 0.3 mil platinum layer and a 1 mil inhibited aluminizing case makes a very effective coating combination for a DS nickel burner ring.

DS nickel is the preferred designation for nickel that is strengthened by having dispersed in it about 2 weight % of finely divided thorium oxide or the like. TD nickel was previously used as such designation.

An aluminum diffusion coating can also be used to prepare catalytic nickel. Thus a foil 5 mils thick of pure nickel can be aluminized in an ammonium chloride-energized pack consisting of 20% aluminum and 80% alumina, using a coating temperature of 1100° F for 10 hours. The coated surface contains at least about 30% aluminum, and when subjected to treatment with 10% aqueous caustic soda at 20 ° to 40° C loses most of its sluminum to the caustic soda, leaving a highly active nickel surface that effectively catalyzes hydrogenation. Th caustic stops reacting when the aluminum content of the surface is sufficiently depleted, and the thus treated surface should, until ready for use, be kept under water or other protective fluid to keep it from heating up as a result of contact with the air. The resulting foil is an effective catalyst for hydrogenating soybean oil for example, using the continuous flow technique as described on pages 522 and 523 of "Unit Processes in Organic synthesis", P. H. Groggins, editor-in-chief, fourth edition, published 1952 by McGraw-Hill Book Company,. A catalyst contact time of about 15 seconds at a temperature of 130° C and a hydrogen pressure of 100 atmospheres effects substantial hydrogenation.

Before the leaching of the aluminum the aluminized foil is quite brittle and should be handled with care. The embrittling is less significant when thicker foils or sheets are aluminized.

Nickel wool, or nickel-plated iron wool or foil, can be aluminized instead of nickel foil to provide the catalytic nickel surface. The dissolving of the aluminum from the surface can be effected with any caustic including caustic potash and can be carried out at a temperature at or below the boiling point of the caustic solution use. The aluminized nickel can be stored as such for many months, until just before catalytic use, the aluminum being then dissolved to provide freshly formed catalyst.

Similar preparation of very active catalytic forms of other metals including platinum and other platinum metals, is described in parent application Ser. No. 507,126, the disclosure of which is incorporated herein as though fully set forth.

Platinum activated in the foregoing manners in very effective for all processed catalyzed by platinum metals. For example it works well in the decomposing of nitrogen oxides as for oxidizing carbon monoxide, hydrocarbons and ammonia. Thus a stream of nitrogen containing 2000 parts per million of higher nitrogen oxides as well as 1% CO, will show no significant nitrogen oxide content after passing through a 0.2 inch thick pile of platinum wire screens (60 mesh, 4 mil wire activated in accordance with Example IV of Ser. No. 507,126) at essentailly atmospheric pressure and an hourly space velocity of 125,000 when the gas stream before contacting the first screen has a temperature of about 230 ° C or higher. The hourly space velocity is the volume of gas flowing per hour divided by the gross volume occupied by the screens. Decreasing the contact time by reducing the number of screens diminishes the effectiveness slightly, but even with only 5 screens in place and at an hourly space velocity of 475,000, about half the nitrogen oxides is removed at 230° C, more than 75% is removed at 250° C, and over 90% removed at about 300° C. The so-called "light-off" temperature for this treatment, with any number of screens, is about 200° C.

The oxidation of CO in a similar stream of nitrogen containing only 1% CO and 1% $O_2$ is even more effective. With the 19 screens and the same gas velocity no CO is detected in the outflow gas when the inflowing gas mixture is at a temperature as low as 210° C. A temperature of about 255° C is needed for this result when 5 screens are used, that is when 14 of the 19 screens are removed. For this oxidation the light-off temperature is a little below 200° C.

The foregoing screen material also exhibits a light-off temperature of 200° C for oxidizing propane in a 0.13% concentration in nitrogen containing 0.88% oxygen. Nevertheless with 19 screens about 80% conversion of the propane is effected at 230° C and about 96% at 310° C. The light-off temperature for burning methane in air, with the foregoing screens, is about 450° F.

It should be noted that when the gas velocities are smaller the various catalytic conversions are more complete and can be effected with fewer screens. Thus even a single platinum screen activated as per Ser. No. 507,126 is a very effective exhaust clean-up device for automotive engine exhaust systems when the engine is operating at low speeds or idling. Also for higher or even maximum engine operating speeds a single activated platinum screen of the present invention is very desirably combined with other exhaust catalyst devices, such as a silica-supported film of platinum palladium alloy, to improve the clean-up effectiveness. Because of the low light-off temperatures of the catalysts of the present invention it is preferred to have the platinum screen of the present invention at the upstream end of the catalytic combination. Such a single screen can have a mesh of from about 10 to about 300 wires per inch, with the wires varying in thickness from about one mil or less to about 10 mils.

The wires can have a square or other non-circular cross-section to thus increase their surface area. Also the wires need not all be identical. A single screen can have wires of different thickness, different cross-section, and different composition. Palladium is a desirable addition to a platinum exhaust catalyst and some of the wires can be of palladium or palladium-platinum alloy. Rhodium is also helpful as a platinum alloying ingredient for strengthening purposes and some or all of the platinum wires can be alloyed with 10 to 30% rhodium before activation. Iridium is also suitable for the same purposes and in the same proportions. Platinum is also strengthened with dispersed oxide such as zirconium oxide, as described by G. L. Selman et al in Platinum Metals Review, April 1974, pp. 2–13, and such dispersion-strengthened platinum makes very active catalyst pursuant to the present invention when activated as described in Ser. No. 507,126. Both the rhodium-alloyed platinum and the dispersion-strengthened platinum are given the coherent three-dimensional microfissured fragmentation structure having fragmentation cells principally ranging from about 500 Angstroms to about 5000 angstroms in size, as described and illustrated in Ser. No. 507,126 by the foregoing activation. It should also be noted that the activating action, particularly for the platinum-rhodium alloys, is improved when using leaching solutions at high temperatures, such as under boiling conditions at atmospheric pressure.

Although not clearly illustrated in that application, all three active platinums also contain pores less than 100 Angstroms in width and in a density of $10^8$ or more, generally $10^9$ or more, pores per square centimeter of gross surface. The gross surface is the outermost surface of the mass of platinum measured with a ruler, ignoring all the fissures and fragmentations. Where the platinum is in the form of a wire having a circular cross-section, its gross surface is the product of the wire length and pi times its diameter. The pores are more clearly shown in the present FIGS. 3 and 4.

Figure 3:
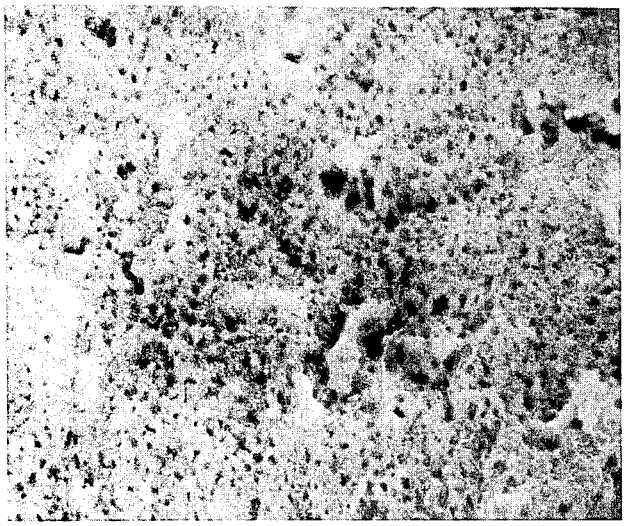
FIG. 3 is a scanning electron micrograph of the surface of a platinum catalyst of the present invention made with the help of aluminum and enlarged 10,000 times.
Figure 4:
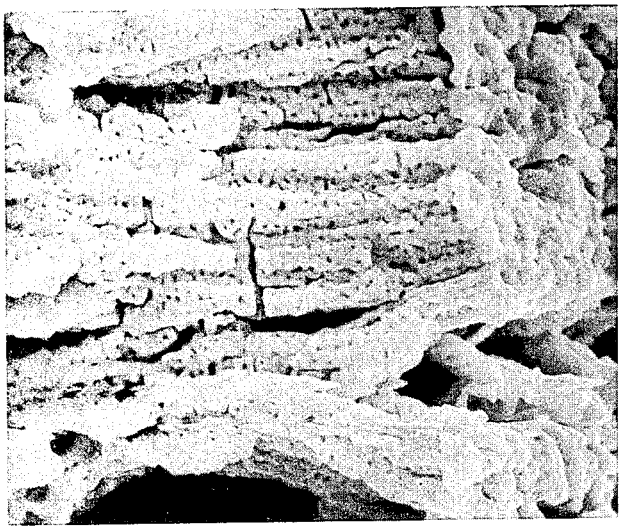
FIG. 4 is a similar sectional view of a platinum catalyst made with the help of zinc.

The platinum of FIG. 3 was prepared as described in Example IV of Ser. No. 507,126, the original platinum being a 60-mesh screen of wires having a circular cross-section and 4 mils in diameter. The platinum of FIG. 4 was made from another portion of the same original screen using the processing procedure of Example XI of Ser. No. 507,126.

The activated strengthened platinums of the present invention are also particularly well suited for catalyzing large-scale HCN production from ammonia-air-hydrocarbon combustion as described in U.S. Pat. No. 3,215,495 for example, where catalytic platinum screens can be as much as six or more feet in diameter and are operated at temperatures over 1100° C. Because the screens of the present invention are so highly active, they light off right away in such use so that there is not significant induction period characteristic of prior art platinum screens in such use. It is thus practical to use one or more fresh screens of pure platinum or platinum alloyed with 10% rhodium activated pursuant to the present invention as the first or top screen, combined with one or more unactivated or used screens downstream of it to make an effective catalytic screen combination giving high HCN yields right from the start.

Because of the high activity of the catalysts of the present invention the ignition of the HCN-forming gas stream occurs rapidly without necessitating an induction period for the thermal roughening of the surface as is the practice in the prior art.

The activated platinum of the present invention, either pure or hardened as above with rhodium or by dispersion-strengthening, is also very effective for oxidizing ammonia to nitric acid as described in Kirk-Othmer Encyclopedia of Chemical Technology, 2nd edition, Vol 13, pp. 802–807, as well as Chemical Week, Vol 98, pp. 85ff (Feb. 19, 1966), and U.S. Pat. No. 3,873,673, and ignites a hydrogen stream in air at as well as below room temperature. These catalysts make very effective igniters for hydrogen-oxygen rocket jets in space vehicles. Hydrogen peroxide jets for such vehicles are also improved by these catalysts, and they ignite a stream of propane in air at temperatures as low as 240° F.

The high effectiveness of the catalysts of the present invention in igniting hydrogen makes then well suited for igniting the fuel in the combustion chambers of hydrogen engines, and for combatting flame-out conditions. For this purpose the hydrogen nozzles in the combustion chambers can have their tips made of the activated platinum of the present invention in tubular form for example. The activated platinum can additionally or alternatively be formed as portions of the combustion chambers or cans.

Other specific processes in which the activated platinum metals of the present invention are effective include polymerization and cracking of hydrocarbons, the combination of $H_2$ with $Cl_2$ to make HCl, and the oxidation of ethanol vapors to acetic acid.

The catalysts of the present invention are also particularly suited for catalytic or so-called "flameless" burning to provide heat. The burning of propane, for example, in this way can be actuated by electrical ignition to ring to operating temperature a wire or small screen of the activated platinum of the present invention, after which the wire or screen will maintain the combustion. Methane and even city gas can also be catalytically burned in this way, although a somewhat higher ignition temperature is needed for such gases.

Alloying the platinum of the present invention with palladium in amounts up to 30% also provides the highly effective catalysis of the present invention in the foregoing uses. The platinum-palladium alloys as well as the platinum-rhodium alloys readily receive a diffusion of aluminum or related metals, and aqueous caustic soda or caustic potash, or hydrochloric acid either by itself or as a follow-up treatment, dissolves out the metal that diffuses in, all as described in Ser. No. 507,126. Where the catalysts of the present invention are used at high temperatures, e.g. at 700° F or higher, it is preferred to leach out all of the metal that is diffused in. To this end it is helpful to use more than one leaching step and to alternate caustic and acid leaches.

A typical activation treatment is as follows:

EXAMPLE 4

A group of 100 circular 60 mesh 4 platinum wire screens 3 feet in diameter is loaded into a 6 inch deep diffusion retort made of plain carbon steel by first pouring into the retort a one-half inch layer of aluminizing pack, then placing a screen over that layer, pouring an additional ¼ inch layer of pack over the screen, placing a second screen over the last layer, and repeating the alternate ¼ inch pack and screen layers until 18 screens are in the retort. An extra 1 inch top layer of pack is applied over the packed stack and $AlCl_3$ energizer then sprinkled over that top layer. The pack is a mixture of 20 weight percent powdered aluminum and 80 weight percent powdered alumina, and the energizer is applied in an amount 0.5% by weight of the foregoing mixture. A plurality of such loaded retorts are then placed within a tall outer retort through which hydrogen can be flushed as shown and described in U.S. Pat. No. 3,801,357, and the assembly heated in a furnace so that the contents of the retorts reach 800°–850° F where they are held for 10 hours, after which the furnace is shut off and the retorts permitted to cool to 400° F, the flushing gas stream stopped, the retorts opened and unloaded. The coated screens thus made are then dropped into a 20 weight percent solution of caustic soda in water where they are kept overnight.After about 16 hours in such solution all traces of bubbling are dissipated, the solution is back to room temperature, and the screens are then removed, washed with water and ready for use.

Large very active screens, such as those 6 feet in diameter, are readily made by securing together as by patch weaving, a plurality of smaller screens.

Instead of activating the platinum metal in the form of screens, it can be activated in the form of ordinary wire, as by diffusion coating loose coils of such wire packed in the foregoing diffusion coating pack in the same retorts, or by submerging such coils in a body of molten aluminum or zinc for about 8 hours, keeping the molten metal just above its melting point. The diffusion coated coils are then leached to dissolve out the aluminum or zinc. The thus-activated wire can then be woven into ordinary screens or coated into flat spirals and braced with a few extra cross wires woven through the turns of the spiral.

Diffusion coatings can also be applied so that some portions of a workpiece contain a thinner coating than other portions. Thus roots or hollow interiors of turbine blades can be arranged to be diffusion coated at the same time the remainder of the blade is diffusion coated, but with less coating than the remainder of the blade. The following example is typical:

EXAMPLE 5

A set of hollow first stage turbine blades of B-1900 alloy had their hollow interiors filled with the following aluminizing pack:

Inside Pack

45% chromium
10% aluminum
Balance alumina plus /178 % $NH_4Cl$

The blade so filled were packed in an aluminizing pack containing:

Outer Pack

10% chromium

11% aluminum
1.4% silicon
Balance alumina plus ½% $NH_4Cl$

All ingredients were −200 mesh. A retort so packed was then subjected to a hydrogen-bathed coating heat at 1800° F for 5 hours, and after clean-up the blades showed a 4.3 milligram per square centimeter pick-up of aluminum on their interior surfaces, with a 10.2 milligram per square centimeter aluminum pick-up on their exterior surfaces. Similar results are obtained whether or not the foregoing packs are given a break-in pre-firing.

In the same way the roots of blades or buttresses of vanes or trailing edges of both blades and vanes can be given coatings thinner than the remainder of the blades or vanes. Reducing the chromium content of the internal pack to 20% increases the internal coating weight. An increase in outer coating is obtained by reducing the chromium content of the outer pack or increasing its aluminum or silicon content.

Conversely, increasing the chromium content of the inner pack to 60% further diminishes the internal coating weight.

Without the chromium in the outer pack the silicon in that pack only slightly diminishes the magnitude of the aluminum it deposits, and without the silicon the changes in chromium content of the outer pack have much less effect. The combination of the chromium, silicon and aluminum provides the coating control when the aluminum content of the pack is as little as 3% and as much as 20%, with the chromium content greater than, preferably about 1.5 to 3 times, that of the aluminum, and the silicon content about 10 to 20% that of the aluminum. The coating temperatures can vary from about 1600° F, preferably 1700° F, to about 2200° F, and the workpieces can be any metal that is not melted at the coating temperature, such as any nickel- or cobalt-based superalloy, DS nickel, DS nichrome, chromium-containing iron, and type 300 and 400 stainless steels.

Omitting the chromium or the silicon or both the chromium and the silicon from the outer pack greatly increases the rate at which the aluminum deposits on the surface of the workpiece.

Nickel can also be used in the diffusion coating packin place of chromium and/or silicon to inhibit the rate at which an aluminum diffusion coating forms.

The B-1900 alloy turbine blades are preferably heat treated at 1975° F for 4 hours followed by rapid cooling at least as fast as air cooling to below 200° F, with a subsequent ageing at 1650° C for 10 hours and a final rapid cooling, in order to develop their best mechanical properties. These heat treating steps can be carried out during the diffusion treatment to differentially coat, by using the snugly fitting containers and procedure described in U.S. Pat. No. 3,824,122 granted July 14, 1974.

Another technique for simultaneously applying two different diffusion coatings is to use different energizers. This is illustrated by the following example:

EXAMPLE 6

The same B-1900 of Example 5 had their interiors filled with the following diffusion coating pack:

Inside Pack 18.5% $Ni_3Al$
18% Alumina
47% Co
15.5% Cr
0.5% $NH_4Cl$

The thus filled blades were packed in the following pack:

Outer Pack 18.5% $Ni_3Al$
18% Alumina
46.5% Co
15% Cr
2% $NH_4I$

Using a 2000° F coating temperature for 10 hours in a hydrogen-bathed atmosphere produced an internal coating which was essentially a chromized case containing a negligible amount of cobalt. On the other hand the outer coating was a case that contained more cobalt than chromium and, after an aluminum top coat, provided a somewhat greater resistance to high temperature oxidation. The two cases had approximately the same thickness. It will be noted that the $Ni_3Al$ in these formulations acted as inert diluent and can be replaced by other nickel aluminides as pointed out above, or by alumina where the formation of oxide inclusion is not objectionable or when the chromizing is effected under subatmospheric pressure.

Mixing the two energizers ($NH_4Cl$ and $NH_4I$ or their equivalents) enables the application of diffusion coatings of intermediate composition. Thus a mixture of 0.5% $NH_4Cl$ and 0.5% $I_2$, both by weight, provides a coating containing almost as much cobalt as chromium. $NH_4Br$ can be used as energizer in place of chloride, the bromide acting very much like the chloride. Other volatilizable compounds of chlorine, bromine and iodine can be used as energizers with similar results so long as there is sufficient chromium and cobalt in the pack to provide the coatings. At least about 10% of each of these metals by weight based on the total metal content of the pack is all that is needed, and it is preferred to have at least about 15% inert filler by weight; without filler the pack tends to sinter together at temperatures of 2000° F or higher.

The wall of the blades of Example 6 does a good job of keeping the diffusion coating atmosphere on the outside of each blade from affecting the diffusion coating atmospheres in the interiors of the blades. Where the different coatings of Example 6 are to be applied to adjacent portions of the outer surfaces, these portions can be effectively separated by a metal wall separating one pack from the other.

Where the pack on one side of such a separating wall has a tendency to vent its activator vapors into the pack on the other side of the wall, as can happen with the foregoing hollow blades when the opening into their hollow interiors is so located that it is submerged in the external pack, it is preferred to have more activator present in the external pack than in the internal pack, and to have a very small amount of activator in the internal pack, for example ¼ to ½% by weight of the pack. Even such a small amount produces substantial excess vapor on heat-up and such vapor is vented out the opening for the hollow interiors. The effect of such vapors in contaminating the activator vapors generated in the external pack is reduced by keeping the activator content low in the internal pack, and swamping any vapors vented into the external pack by a larger activator content in the external pack as well as by the use of much more external pack than internal pack.

As in the case of simple diffusion coating packs, the inside and outer packs of Example 6 can be reused. It is desirable for such reuse to replenish the packs for so much of their contents as have been consumed in a coating operation. This keeps the pack fairly uniform in composition so it is not necessary to make many adjustments for such reuse or even for repeated reuse. Inasmuch as the activator is fairly thoroughly driven off during any diffusion coating operation, an inside pack can be used as an outer pack or vice versa, the amount and nature of the activator being selected to match the nature of the reuse rather than the past history of the pack. If it is no trouble to adjust the coating conditions for reuse without replenishment, this can also be done.

The pack of Example 1 can also be similarly reused with or without replenishment.

The foregoing chromium and cobalt-chromium coatings are particularly suited for application at temperatures of at least 1700° F to protect nickel-base superalloys against high temperature oxidation and sulfidation, in which event it is preferred to apply over these coatings a diffusion coating of aluminum or a coating of aluminum-chromium mixtures such as those described in U.S. Pat. Nos. 3,528,861 and 3,676,085. For these purposes the differential coatings are preferably applied with the use of a retort effectively not over five inches high.

The following additional examples show modified forms of differential diffusion coating:

EXAMPLE 7

Jet engine hot section blades composed of PWA-1422 and with hollow interiors, were coated so the outer air foil-surface had a heavy aluminized case and the root a thin aluminized case, with the interiors uncoated. This alloy has the following composition:

Chromium; 9%
Cobalt; 10%
Titanium; 2%
Colombium; 1%
Aluminum; 5%
Tungsten; 12.5%
Carbon; 0.15%
Boron; 0.15%
Zirconium; 0.05%
Hafnium; about 1%
Nickel; Balance To make sure the blades were clean their external and internal surfaces were first solvent cleaned in trichloroethylene, then dry blasted with 220 grit aluminum oxide propelled by air at a pressure of 30 psig. Any residual abrasive was then blown off the blades. The interiors of the blades were then filled with the masking composition made up of equal parts by weight of $Ni_3Al$ and alumina to which mixture is added metallic chromium so that its concentration is 1.6% by weight, all ingredients being −240 mesh. The blades were then packed in individual retort arrangements.

Figure 2:
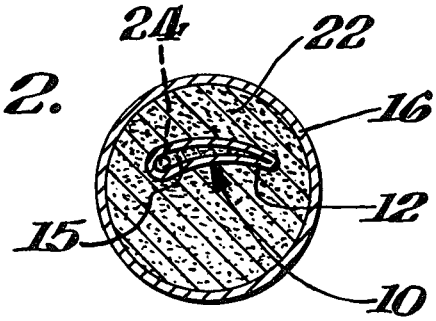
FIG. 2 is a cross-sectional along line 2—2 of FIG. 1 of a workpiece packed in the retort.

The outer air foil section of each blade was packed in a closely fitting pre-aluminized plain carbon steel tube with the following heavy coating pack composition (all percentages by weight):

20% chromium powder the particles of which range in size from about 1 to about 10 microns,
11% -250 mesh aluminum-silicon alloy containing approximately 88% aluminum and 12% silicon,
68.5% 325 mesh aluminum oxide,
0.5% ammonium chloride The packing was as illustrated in FIGS. 1 and 2 where each blade is shown at 10, its air foil section at 12, its root at 14, the masking pack at 15, the opening through which the masking pack is inserted at 24, the pre-aluminized steel tube at 16, and the heavy coating pack at 18. It was then placed in a large retort 20 and a number of additional blades similarly prepared were placed alongside it in that retort. Over this assembly in the retort there was poured the following light coating pack 22 (all percentages by weight):

45% of the same chromium powder used in the heavy coating pack,
15% 325 mesh aluminum powder,
39.5% 325 mesh aluminum oxide,
0.5% ammonium chloride.

Before the packing each of the packs was broken in by heating to 1600° F or higher for 5 hours, after which the ammonium chloride content of the packs was returned to its original value by supplemental additions.

A number of retorts 20 were then piled up within an outer retort as described in U.S. Pat. No. 3,764,371, and heated by a surrounding furnace under a hydrogen atmosphere to 1650° F plus or minum 25° F, which temperature was held for 4 hours. The assembly was then cooled under hydrogen, the hydrogen subsequently flushed out and the retorts opened and unloaded. The individual blades still with their air foil sections packed in tube 16, were then removed from the outer pack, a process which is easily accomplished inasmuch as the relatively low treatment temperature does not cause the pack particles to adhere together very tightly. The individual blades were then withdrawn from the individual tubes, and the masking mixtures in the hollows of the blades were finally poured out through the same air-cooling openings 24 used for introducing that mixture. With the help of a blast of air all residual packing and masking powder was blown off and the blades thus cleaned next placed in a furnace where they were heated under dry hydrogen to 1975° F at which temperature they were held for four hours, following which they were rapidly cooled down with the help of a hydrogen flush to about 300° F over a one hour period. They were then heated in air, argon or hydrogen or other inert atmosphere at 1650° F for 10 hours to complete their preparation for use. The average case depth for the outer air-foil surface was 3.6 mils and the average case depth for the roots was 1.8 mils.

Essentially the same results are obtained when the workpieces are completely packed in individual snugly fitting retort tubes as described in U.S. Pat. No. 3,824,122 and subjected to the heat treatment sequence while still in those tubes and during the coating step, as also described in that patent.

When coating with a diffusion coating pack in which the metal content is aluminum, or a mixture of aluminum and silicon, a prior break-in heat with such pack is not needed.

Using the manipulative technique of Example 7 or the alternative technique described in U.S. Pat. No. 3,824,122, the process of Example 7 can be modified so the interior surface of the blade is also coated, by substituting for the masking pack the light coating pack used around the root. Three different coatings can be simultaneously applied by using the chromizing packs of Example 6 against the root and outer air foil surface of a hollow blade, while aluminizing its interior surface. Thus the inside pack of Example 6 can be applied to the root, the same pack but with its $NH_4Cl$ replaced by an equal quantity of $NH_4I$ used against the outer air foil surface, and the lighter aluminizing pack of Example 7 packed in the hollow interior of the blade. The blade thus coated is particularly suited to receive on its outer air foil surface and on its root surface the top coatings of U.S. Pat. Nos. 3,528,861 or 3,676,085.

Alternatively the root surface is masked and the interior surface of the air foil given the light aluminum coating while the external surface of the air foil the heavy coating. A still further alternative is to subject the external surface of the air foil to the coating treatment described in U.S. Pat. Nos. 3,528,861 or 3,676,085 while the internal surface of the air foil is masked and the root subjected to the light coating of Example 5. If desired the coating of U.S. Pat. Nos. 3,528,861 or 3,676,085 can be applied in this combination after the diffusion aluminizing of the root, and directly to the external surfaces of the air foil, or after those external surfaces have been given a heavy or light aluminizing.

The following are further examples of differential coating:

EXAMPLE 8

A row of jet engine vanes made of cobalt-base superalloy X-40 is packed in an Incoloy 800 retort with their external airfoil surface embedded in the following powder pack mixture (by weight):

Aluminum; 10%
Chromium (very fine particles); 30%
Alumina; 59.5%
$NH_4Cl$; 0.5%

The pack mixture had been prefired, a treatment that drove off essentially all the original $NH_4Cl$, and an additional quantity of fresh $NH_4Cl$ mixed with the prefired material after it had cooled down.

The packing was effected by aligning the vanes so the buttresses of each vane end were on the left and right of the row of vanes. The powder pack beyond the buttresses was then sucked away by a vacuum cleaner with a small nozzle, leaving the far surfaces of the buttresses uncovered.

Against these uncovered surfaces is then poured and tamped down the following powder pack mixture (by weight):

Aluminum; 10%
Chromium (very fine particles); 45%
Alumina; 44.5%
$NH_4Cl$; 0.5%

This pack mixture had also been prefired and had its $NH_4Cl$ replenished. The final assembly is then subjected to diffusion coating conditions in a glass-sealed retort assembly at 2050° F for 20 hours. After cooling to 200° F the glass seal is broken and the retort emptied. The vanes are cleaned with a light blasting by very fine glass microspheres blown by a stream of air from a 10 psig supply, and are beige-colored, showing that they are coated all over. However the coating on the end faces of the buttresses measures about 2.5 mils in case depth, whereas the airfoil surface coating measures about 3.5 mils in case depth.

Limiting the diffusion coating treatment so that the heating of the packed retort is at 1950° F for 16 hours produces an outer buttress coating case of about 1.5 mils and an airfoil coating case of about 2.5 mils.

EXAMPLE 9

First stage hot section jet engine blades of PWA 663 alloy have their airfoil surfaces embedded in the following diffusion pack:

15% chromium powder
10% powdered aluminum-silicon alloy containing 88% by weight aluminum
balance $Al_2O_3$ powder activated with ½% ammonium chloride.

The roots of the vanes as well as their hollow interior surfaces are packed in the following pack which provides a thinner case:

45% powdered chromium
15% powdered aluminum
balance $Al_2O_3$ powder activated with ½% ammonium chloride.

The vanes so packed are subjected to a diffusion coating heat where they are held at 1600° F for 4 hours in a hydrogen bathed atmosphere. The resulting coating on the airfoil surface is from 3 to 4½ mils thick while the coating on the remaining surfaces can range from ½ to 2½ mils thick.

A similar differential coating can be applied to other nickel-based superalloys, such as PWA 1422, but for such alloys the diffusion coating temperature can be increased to 1670° F, and the time at that temperature can be reduced to 3 hours or even less. The nickel-based alloys so coated are preferably post-diffused at 1975° F for from 4 to 8 hours in a hydrogen atmosphere after they are removed from the coating pack, and then air cooled at 40° F per minute or faster down to a temperature at least as low as 1000° F.

EXAMPLE 10

First stage hot section blades of a jet engine, which blades are also made of PWA 1422 alloy are coated in the following pack:

8.8% powdered aluminum
1.2% powdered silicon
15% powdered chromium
balance $Al_2O_3$ powder activated with ½% ammonium chloride while the hollow internal surface of the blades and their roots are coated in the following mixture:

8.8% powdered aluminum
1.2% powdered silicon
30% powdered chromium
balance $Al_2O_3$ powder activated with ½% ammonium chloride.

The coatings thus produced at the temperatures given in Example 9 are about the same thickness as the coatings of Example 9.

The coating packs of Example 10 can also be used to differentially coat nickel-based alloy vanes of PWA 1455. This alloy is effectively coated at 1620° to 1670° F for 3 hours, post-diffused and air cooled as described above for B-1900, then aged at 1650° F in air or hydrogen for 10 hours, and then cooled at a rate of at least 35° F per minute to below 1000° F.

Similar results are obtained with alloys modified by the addition of 1 to 1.5% hafnium to increase ductility and yield strength, as well as diminish high temperature creep.

For even greater engine life the superalloys coated as in Examples 5 through 10 can have their diffusion-coated airfoil surfaces given a top coating of the Co-Cr-Al-y alloy as described in U.S. Pat. No. 3,676,085, and their internal surfaces as well as their roots can be kept masked during such top coating.

When pack diffusion coating the interior of a hollow vane or blade whose exterior has been coated, or when pack-diffusion coating a relatively small portion of a workpiece surface, as for instance to touch up a defective spot having an area up to about 10% of a prior coating in the manner shown in FIGS. 2 and 3 of U.S. Pat. No. 3,801,357 granted Apr. 2, 1974, it is not necessary to apply to the remaining surfaces a pack that masks by some kind of gettering action such as the action of $Ni_3Al$ on aluminum. However to keep the remaining surfaces from excessive deterioration they can be packed in an essentially inert pack containing a depletion-reducing amount of the critically diffusible metal ingredients in those surfaces. To this end an aluminized superalloy surface being touched up in one area by further aluminizing, can have its remainder packed in a pack of powdered alumina or other inert material, containing by weight about ¼% finely divided aluminum metal and about 1% finely divided chromium metal, or an equivalent amount of an aluminum-chromium alloy. The aluminum content of the pack can range from about ⅛% to about 2% by weight and even somewhat below ⅛%, and the chromium content can also have the same range. The use of aluminum without chromium in the inert pack, is also helpful but is not as desirable.

Similarly, coating the interior of a blade whose exterior has already been given the cobalt-chromium-aluminum-yttrium coating of U.S. Pat. No. 3,676,085 applied over an aluminized or chromized case, is preferably carried out with the previously coated exterior of the workpiece surface embedded in a pack of powdered alumina or other inert material, containing about 1½ cobalt, about ½% chromium, and about ¼% aluminum, all calculated by weight. Preferred concentration ranges for these three metals in such pack are:

Cobalt; ½ to 10%
Chromium; ¼ to 3.5%
Aluminum; ⅛ to 2%

Although the cobalt-chromium-aluminum-yttrium coating being protected also contains a small but critical amount of yttrium, that yttrium does not appear to be a critically diffusible metal whose depletion needs a safeguard such as the presence of a little yttrium metal in the inert pack. The cobalt, chromium and aluminum particles present in the inert pack can be either of the individual metals, or alloys of any two or all three of these metals. In general aluminum, chromium, nickel and cobalt are the critical diffusible metals found in protective coatings on superalloys. The masking pack of Example 7 is also such a depletion-preventing pack.

The foregoing inert packs containing depletion-reducing ingredients can be reused. When reused, their metal ingredients will generally be inter-alloyed as a result of the prior use.

In some cases depletion of diffusible material from a workpiece surface is beneficial. As noted in U.S. Pat. No. 3,647,517 granted Mar. 7, 1972, aluminide coatings diffused onto the surface of cobalt-base superalloy workpieces are generally quite brittle, so that the protection provided by those aluminide coatings leaves something to be desired. However pretreating the workpieces so as to effect substantial diffusion depletion from those surfaces then causes an aluminide coating subsequently applied to be much less brittle.

The following is a typical example:

EXAMPLE 11

A group of Mar-M-509 jet engine turbine vanes was packed in a plain carbon steel retort in a powder pack of equal parts by weight 325 mesh alumina and finely divided nickel the particles of which are about 40 microns in size. The pack is activated with about ½% by weight ammonium chloride and the retort so packed is heated in hydrogen to a temperature of 2,000° F for 20 hours. The hydrogen atmosphere was provided as shown in U.S. Pat. No. 3,764,371.

At the completion of the heating the retort was permitted to cool and the cooled vanes removed from the pack. These vanes showed a weight loss of about 35 milligrams square centimeter over their entire surface, and a typical cross section of a vane showed on microscopic examination a significant number of voids adjacent the surface that was in contact with the pack.

The resulting vanes were then given a chromium-inhibited aluminum diffusion coating from a diffusion coating pack in accordance with Example 3, but with the maximum heating temperature at 2050° F maintained for 20 hours. The final vanes had an aluminized case approximately 6 mils deep which exhibited unusually high resistance to impact damage. The same aluminizing carried out on a non-depleted Mar-M-509 vane provides an aluminized case only about 3 mils thick and very brittle.

The Mar-M-509 alloy is a well known cobalt-base superalloy and its composition is given in U.S. Pat. No. 3,647,517. Other cobalt-base alloys such as the additional five listed in Table 1 of the last-mentioned patent also lend themselves to this improved procedure for coating with an impact-resistance protective aluminide case. In each instance the depletion should provide a weight loss from about 3 to about 75 milligrams per square centimeter of surface. No scale is formed on the workpiece surface as a result of the depleting step, and the scale removal operation referred to in U.S. Pat. No. 3,647,517 is not needed.

Instead of nickel alone as the metallic ingredient of the depleting pack, alloys of nickel with aluminum for example can be used, although a proportion of aluminum larger than that in $Ni_3Al$ is not desired. The nickel or nickel alloy can also be replaced by cobalt, and any of these metals can be present in the depleting pack in a proportion of from about 10 to about 90% by weight, the remainder of the pack being either alumina or any other inert diluent such as magnesia, to keep the metal particles from sintering together. It is preferred that the metal particles be no greater than about 200 microns in size.

The retort can be of steel, stainless steel or nickel-base alloys, and its composition does not seem to affect the process so long as it does not contain low melting metals such as zinc.

The pack activator can be any halide diffusion activator including ammonium iodide, ammonium bromide, ammonium bifluoride, elemental iodide or bromine, etc., and its content can be as low as ⅛th of 1% of the pack by weight. The depleting temperature to which the cobalt-base superalloy or pieces are subjected in contact with the pack can be as low as 1600° F or as high as 2200° F, and the depleting times can be as little as 2 hours to as much as 100 hours, the longer times being used with the lower temperatures and vice versa.

Instead of hydrogen atmosphere during the depletion, the atmosphere can be of inert gas such as argon. The activator provides a halide vapor upon heat-up and such vapor accelerates the depletion in much the same manner as it accelerates the diffusion coating of workpieces.

The more impact-resistant aluminized cobalt-base superalloy vanes and the like made in the foregoing manner are particularly desirable for use in jet engines such as those in aircraft where these articles are subject to impact damage, and make long-lived first stage hot section vanes.

Nickel base superalloys also show the foregoing depletion when subjected to the foregoing diffusion depletion action, but protective diffusion aluminized cases on nickel base superalloys are not nearly as brittle as those on cobalt base superalloys, so that the aluminizing of the depleted nickel base superalloys provides a case with only a little more impact resistance as compared with the aluminizing of untreated nickel base superalloys.

Obviously many modifications and variations of the present invention are possible in the light of the above teachings. It is therefore to be understood that within the scope of the appended claims the invention may be practiced otherwise than as specifically described.

What is claimed is:

1. In the chromizing of a superalloy article by diffusion coating the article in a chromium-containing powder pack at atmospheric or superatmospheric pressure to cause the surface of the article to pick up at least 1 milligram of chromium per square centimeter, the improvement according to which the diffusion coating is effected with essentially no alpha-chromium formation by conducting it in an unperforated retort cup not over about 5 inches in height.

2. The process of claim 1 in which the unperforated retort cup is the lowest portion of a taller retort whose walls are perforated above that lowest portion.

3. The process of claim 1 in which the unperforated retort height is at least about 2 inches.

4. The improved chromizing of claim 1 in which the chromium-containing powder pack also contains about 3% to about 20% by weight of a nickel aluminide ranging from $Ni_{3.5}Al$ to $Ni_2Al$.

5. The improved chromizing of claim 1 in which the chromizing atmosphere is bathed by a stream of inert gas.

6. The improved chromizing of claim 5 in which the chromium-containing powder pack also contains about 3% to about 20% by weight of a nickel aluminide ranging from $Ni_{3.5}Al$ to $Ni_2Al$.

* * * * *

UNITED STATES PATENT AND TRADEMARK OFFICE

CERTIFICATE OF CORRECTION

PATENT NO. : 4,041,196

DATED : August 9, 1977

INVENTOR(S) : Alfonso L. Baldi et al

It is certified that error appears in the above-identified patent and that said Letters Patent are hereby corrected as shown below:

Col. 1, lines numbered 46-58, should be indented.

Col. 2, line 63, "spaced" should be --space--.

Col. 3, line 1, "35" should be --3%--.

line 6, --phase-- should be inserted after "alpha".

line 19, "cam" should be --can--.

line 27, "EXAMPLE2" should be --EXAMPLE 2--.

Col. 4, lines numbered 23-34, should be indented.

line 59, "sluminum" should be --aluminum--.

line 61, "Th" should be --The--.

Col. 5, line 15, "use." should be --used.--.

line 24, "in" should be --is-- (second occurrence).

UNITED STATES PATENT AND TRADEMARK OFFICE

CERTIFICATE OF CORRECTION

PATENT NO. : 4,041,196

DATED : August 9, 1977

INVENTOR(S) : Alfonso L. Baldi, et al

It is certified that error appears in the above-identified patent and that said Letters Patent are hereby corrected as shown below:

Col. 5, line 25, "processed" should be --processes--.

line 34, "essentailly" should be --essentially--.

Col. 6, line 29, --also-- should be inserted after "platinum".

Col. 7, line 48, "ring" should be --bring--.

Col. 8, line numbered 3, "100" should be deleted and --mil-- should be inserted after "4".

lines numbered 56-68, should be indented.

Col. 9, lines 1-12, should be indented.

line 45, "packin" should be --pack in--.

line numbered 62, --blades-- should be inserted after "B-1900".

lines numbered 62-68, should be indented.

UNITED STATES PATENT AND TRADEMARK OFFICE

CERTIFICATE OF CORRECTION

PATENT NO. : 4,041,196

DATED : August 9, 1977

INVENTOR(S) : Alfonso L. Baldi et al

It is certified that error appears in the above-identified patent and that said Letters Patent are hereby corrected as shown below:

Col. 10, lines 1-25, should be indented.

Col. 11, line 44, "Boron; 0.15%" should be --Boron; 0.015%--.

Col. 13, lines 26-64, should be indented.

line 39, "of" should be --at-- (first occurrence).

line 52, before "had", second occurrence insert -- had--.

Col. 14, lines numbered 3-17, should be indented.

lines numbered 36-53, should be indented.

Col. 16, line numbered 15, --per-- should be inserted after "milligrams".

Signed and Sealed this

*Twenty-ninth* Day of *April 1980*

[SEAL]

*Attest:*

SIDNEY A. DIAMOND

*Attesting Officer*

*Commissioner of Patents and Trademarks*